US011717122B2

(12) United States Patent
Tang et al.

(10) Patent No.: US 11,717,122 B2
(45) Date of Patent: Aug. 8, 2023

(54) DUST SCRAPING DEVICE AND CLEANING APPARATUS

(71) Applicants: Beijing Shunzao Technology Co., Ltd., Beijing (CN); BEIJING XIAOMI MOBILE SOFTWARE CO., LTD., Beijing (CN)

(72) Inventors: Cheng Tang, Beijing (CN); Fei Duan, Beijing (CN); Liang Zhong, Beijing (CN); Chongyue Xu, Beijing (CN); Peiheng Zhu, Beijing (CN); Lu Han, Beijing (CN)

(73) Assignees: BEIJING SHUNZAO TECHNOLOGY CO., LTD., Beijing (CN); BEIJING XIAOMI MOBILE SOFTWARE CO., LTD., Beijing (CN)

( * ) Notice: Subject to any disclaimer, the term of this patent is extended or adjusted under 35 U.S.C. 154(b) by 0 days.

(21) Appl. No.: 17/563,382

(22) Filed: Dec. 28, 2021

(65) Prior Publication Data

US 2022/0369878 A1 Nov. 24, 2022

(30) Foreign Application Priority Data

May 20, 2021 (CN) ..... 202121089446.8

(51) Int. Cl.
*A47L 9/06* (2006.01)
*A47L 5/24* (2006.01)
(Continued)

(52) U.S. Cl.
CPC ..... *A47L 9/0626* (2013.01); *A47L 5/24* (2013.01); *A47L 9/127* (2013.01); *A47L 9/1691* (2013.01)

(58) Field of Classification Search
CPC ..... A47L 9/1608; A47L 9/1683; A47L 5/24; A47L 9/106; A47L 9/20; A47L 9/322; B01D 45/08; B01D 45/10
(Continued)

(56) References Cited

U.S. PATENT DOCUMENTS

2012/0148332 A1* 6/2012 Stredak ..... A45D 40/267 401/292
2019/0200824 A1* 7/2019 Campbell-Hill ..... A47L 9/1608
(Continued)

FOREIGN PATENT DOCUMENTS

CN 108814420 A * 11/2018 ..... A47L 9/00
CN 111449568 A * 7/2020
(Continued)

OTHER PUBLICATIONS

CN-108814420-A description from Espacenet (Year: 2022).*
(Continued)

*Primary Examiner* — Brian D Keller
*Assistant Examiner* — Tim Brady
(74) *Attorney, Agent, or Firm* — Cozen O'Connor

(57) ABSTRACT

A dust scraping device for a cleaning apparatus includes a dust cup and a removable cyclone separation unit arranged in the dust cup. The dust scraping device includes a dust scraping member. The dust scraping member has a connection portion extending in a removal direction of the cyclone separation unit, and a dust scraping portion extending to an interior of the dust cup in a direction perpendicular to the removal direction and slidably abutting against the cyclone separation unit. The dust scraping device is mounted at the dust cup, and the dust scraping portion scrapes off at least part of debris on an outer side of the cyclone separation unit when the cyclone separation unit is removed from the dust cup.

18 Claims, 4 Drawing Sheets

(51) Int. Cl.
*A47L 9/12* (2006.01)
*A47L 9/16* (2006.01)

(58) Field of Classification Search
USPC ..... 15/352, 359
See application file for complete search history.

(56) References Cited

U.S. PATENT DOCUMENTS

| | | | | |
|---|---|---|---|---|
| 2019/0200825 | A1* | 7/2019 | Crouch | A47L 9/165 |
| 2019/0200827 | A1* | 7/2019 | Crouch | A47L 9/322 |
| 2019/0200830 | A1* | 7/2019 | Crouch | A47L 9/0693 |
| 2022/0047132 | A1* | 2/2022 | Lee | A47L 9/127 |

FOREIGN PATENT DOCUMENTS

| | | | |
|---|---|---|---|
| CN | 111449568 | A | 7/2020 |
| CN | 112568782 | A | 3/2021 |
| EP | 3405087 | A1 | 11/2018 |
| JP | 2002051953 | A | 2/2002 |
| JP | 2005168775 | A | 6/2005 |
| JP | 3964854 | B2 | 8/2007 |
| JP | 6534495 | B2 | 6/2019 |
| KR | 20210038204 | A | 4/2021 |
| RU | 2253348 | C1 | 6/2005 |
| WO | WO 2021036039 | A1 | 3/2021 |

OTHER PUBLICATIONS

CN-111449568-A description from Espacenet (Year: 2022).*
European Patent Application No. 21217965.9 Search and Opinion dated Jun. 24, 2022, 8 pages.
Japanese Patent Application No. 2021-211898, Office Action dated Nov. 4, 2022, 5 pates.
Japanese Patent Application No. 2021-211898, English translation of Office Action dated Nov. 4, 2022, 5 pates.
Indian Patent Application No. 202144062233, Office Action dated Nov. 29, 2022, 5 pages.

* cited by examiner

DUST SCRAPING DEVICE AND CLEANING APPARATUS

CROSS-REFERENCE TO RELATED APPLICATIONS

This application claims benefit of and priority to Chinese Patent Application Serial No. 202121089446.8, filed on May 20, 2021, the entire contents of which are incorporated herein by reference.

FIELD

The present disclosure relates to a field of cleaning apparatus and, more particularly, to a dust scraping device and a cleaning apparatus.

BACKGROUND

In daily life, hand-held cleaning apparatuses such as vacuums are often used in house cleaning. The handheld cleaning apparatus has a cyclone separation unit arranged in a dust cup. The dust cup is detachably coupled to a main body of the cleaning apparatus. During use of the cleaning apparatus, dirt such as hair or debris enters the dust cup via an air inlet tube of the cleaning apparatus, and separation of dirt and air is carried out by the cyclone separation unit in the dust cup, so that the dirt is retained between the dust cup and the cyclone separation unit, and clean air is discharged out of the cleaning apparatus from an air outlet of the main body of the cleaning apparatus.

SUMMARY

Embodiments of the present disclosure provide a dust scraping device for a cleaning apparatus. The cleaning apparatus includes a dust cup and a removable cyclone separation unit arranged in the dust cup. The dust scraping device includes a dust scraping member. The dust scraping member has a connection portion extending in a removal direction of the cyclone separation unit, and a dust scraping portion extending to an interior of the dust cup in a direction perpendicular to the removal direction and slidably abutting against the cyclone separation unit. The dust scraping device is mounted at the dust cup, and the dust scraping portion scrapes off at least part of debris on an outer side of the cyclone separation unit when the cyclone separation unit is removed from the dust cup.

Embodiments of the present disclosure provide a cleaning apparatus including: a gun-shaped main body; a main machine mounted on the main body; a dust cup; a removable cyclone separation unit arranged in the dust cup; and a dust scraping device. The dust scraping device includes a dust scraping member. The dust cup and the main machine are arranged on the main body, and the dust scraping device is fixedly mounted at the dust cup and is coupled to the main machine by an engagement structure. The dust scraping member has a connection portion extending in a removal direction of the cyclone separation unit, and a dust scraping portion extending to an interior of the dust cup in a direction perpendicular to the removal direction and slidably abutting against the cyclone separation unit. The dust scraping device is mounted at the dust cup, and the dust scraping portion scrapes off at least part of debris on an outer side of the cyclone separation unit when the cyclone separation unit is removed from the dust cup.

DETAILED DESCRIPTION OF EMBODIMENTS

In order to better explain the present disclosure and facilitate understanding, specific embodiments of the present disclosure will be described in detail below in conjunction with the accompanying drawings. Terms such as "upper," "lower," "left" and "right" used herein refer to orientations shown in FIG. 1. A side where a main body 80 is located is defined as "lower," and a side where a dust cup 20 and a main machine 60 are located is defined as "upper."

The inventors have found during research that the dust cup needs to be cleaned after being used for a period of time, and during cleaning, the dust cup is removed from the main body of the cleaning apparatus and cleaned. Moreover, after the cleaning apparatus is used for a period of time, hair and other dirt may be easily wound around an outer circumference of a filter screen in the cyclone separation unit, which makes it difficult to clean the cleaning apparatus.

Figure 1:
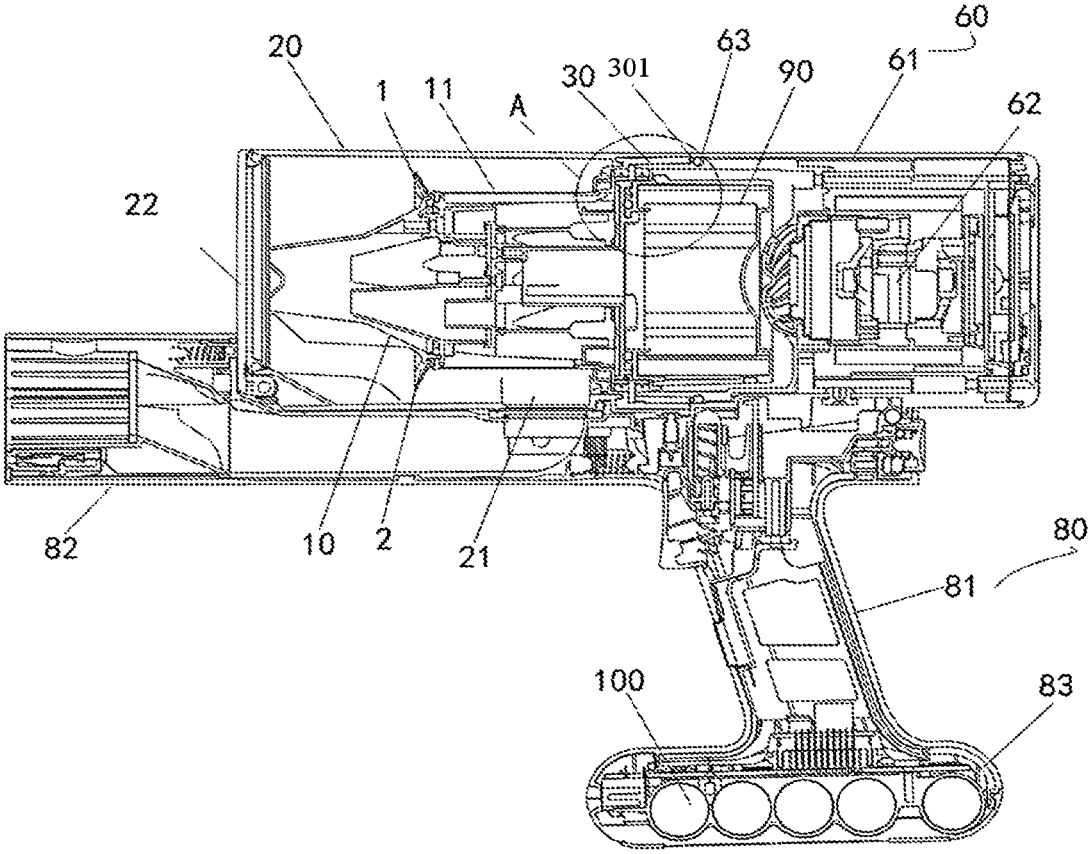
FIG. 1 is a sectional view of a cleaning apparatus according to the present disclosure.

In an aspect, referring to FIG. 1, embodiments of the present disclosure provide a cleaning apparatus, including a main body 80, a main machine 60 mounted on the main body 80, a dust cup 20, and a removal cyclone separation unit 10 arranged in the dust cup 20. The cleaning apparatus further includes a dust scraping device used for the cleaning apparatus.

The dust cup 20 and the main machine 60 are arranged on the main body 80, and the dust scraping device is fixedly mounted on the dust cup 20 and coupled to the main machine 60 by an engagement structure.

The main machine 60 includes a main machine housing 61 and a blower 62 mounted in the main machine housing 61.

A lower end surface of the main machine housing 61 extends outwards and forms a cylindrical connection end. Three engagement blocks 63 are integrally formed and arranged at equal intervals outside the connection end, and the engagement blocks are fitted, engaged and fixed with engagement slots 301 formed in the dust scraping device on the dust cup 20. Due to the arrangement of the engagement blocks 63 and the engagement slots 301, the dust cup 20 and the main machine 60 can be assembled or disassembled quickly and conveniently.

The blower 62 is electrically coupled to a master control circuit within the main body 80 and is used to draw in external air.

Embodiment 1

Figure 2:
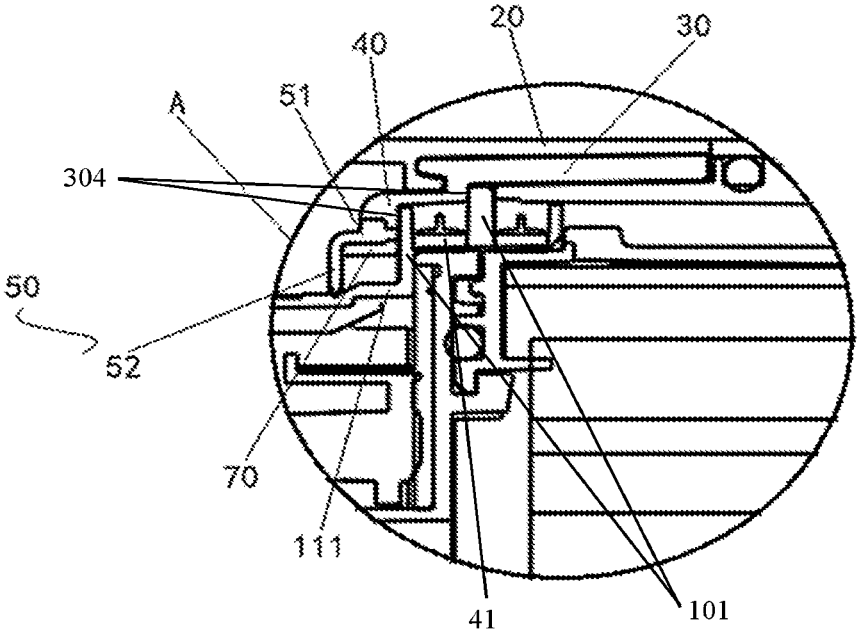
FIG. 2 is an enlarged view of part A circled in FIG. 1.
Figure 3:
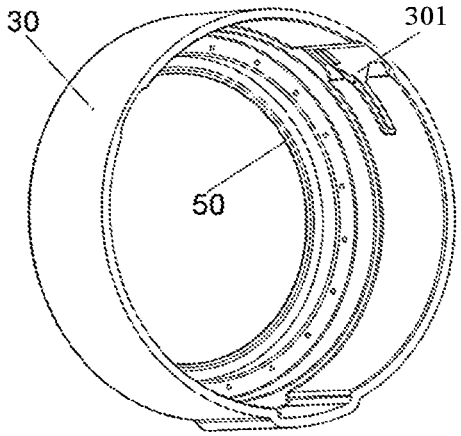
FIG. 3 is a perspective view of a dust scraping device for a filter screen according to the present disclosure.

Based on the above technical solutions, referring to FIG. 2 and FIG. 3, the dust scraping device includes a dust scraping member; and the dust scraping member has a connection portion extending in a removal direction of the cyclone separation unit 10, and a dust scraping portion extending to an interior of the dust cup 20 in a direction perpendicular to the removal direction and slidably abutting against the cyclone separation unit 10.

The dust cup 20 has a cylindrical dust cup main body and an open portion arranged at an end of the dust cup main body; the dust scraping member is a cylindrical dust scraping ring 50; and the dust scraping ring 50 is coaxially mounted at the open portion of the dust cup 20.

The cyclone separation unit 10 is coaxially arranged within the dust cup 20, the cyclone separation unit 10 includes a cylindrical filter screen 11 and a cyclone separation portion located downstream of the filter screen 11. The dust scraping ring 50 is capable of scrapping off debris on an outer side of the filter screen 11, and the debris falls into the dust cup 20.

The main body 80 has a gun-shaped structure, and includes a first transverse connection portion 82 substantially extending transversely and a handheld portion 81 substantially extending longitudinally. A fluid channel substantially extending transversely is arranged in the first transverse connection portion 82; and the fluid channel has a first end used as an air inlet and a second end coupled to a dust cup air inlet 21 of the dust cup 20. A dusty air flow enters the dust cup 20 from the air inlet of the fluid channel of the first transverse connection portion 82 and through the dust cup air inlet 21, and is subjected to dust and gas separation by the cyclone separation unit 10 coaxially arranged in the dust cup 20. Referring to FIG. 1, a first cyclone separation stage is formed between the filter screen 11 and an inner wall of the dust cup 20, and the dusty air flow may be subjected to primary dust and gas separation by the first cyclone separation stage. A skirt partitioning device is arranged at a left end, away from the open portion, of the filter screen 11, and the skirt partitioning device divides an inner chamber of the dust cup 20 into a cyclone separation section (i.e., the first cyclone separation stage) and a dirt collection section.

The dusty air flow entering the dust cup 20 is firstly subjected to first cyclone separation around the outer circumference of the filter screen 11, and the first cyclone separation stage is formed between the filter screen 11 and the dust cup 20, wherein dirt separated by the first cyclone separation stage is collected in a first dirt collecting region. Then, a gas separated by the first cyclone separation stage enters a plurality of cyclone cones inside the filter screen 11 via holes in the filter screen 11 so as to be subjected to second cyclone separation, and the plurality of cyclone cones inside the filter screen 11 form a second cyclone separation stage. Dirt separated by the second cyclone separation stage is discharged from dirt outlets of all the cyclone cones and is collected. Referring to FIG. 1, a second dirt collecting region is arranged on the left side of each of the cyclone cones and is used for collecting the dirt discharged by each of the cyclone cones. The gas separated by the second cyclone separation stage is discharged to a downstream HEPA filter device and the like via air outlets of the cyclone cones and is finally discharged to the outside.

It should be noted that the filter screen 11 is a perforated plate made of a hard material, such as a metal plate. The holes are provided for the purposes of facilitating the passing of the gas separated by the first cyclone separation stage and ensuring that larger-sized dirt is intercepted on the outer side of the filter screen 11 by the filter screen 11. The plurality of cyclone cones of the second cyclone separation stage are annularly arranged, and accommodating spaces are formed among the left ends of the plurality of cyclone cones and are used for accommodating a certain dirt in the second dirt collecting region.

Due to the adoption of the structure that the plurality of cyclone cones are annularly arranged, space is sufficiently utilized during layout of the cyclone separation unit 10, and the cyclone separation unit 10 is compact in structure. Moreover, the cyclone separation unit 10 allows more cyclones to be arranged in the finite space, and thus, the dust and gas separation efficiency of the cyclone separation unit 10 is increased.

Embodiment 2

The dust scraping device includes a dust scraping member, and the dust scraping member has a connection portion extending in a removal direction of the cyclone separation unit 10 and a dust scraping portion extending to an interior of the dust cup 20 in a direction perpendicular to the removal direction and slidably abutting against the cyclone separation unit 10.

The dust cup 20 has a cylindrical dust cup main body and an open portion arranged on one end of the dust cup main body, the dust scraping member is a cylindrical dust scraping ring 50, and the dust scraping ring 50 is coaxially mounted on the open portion of the dust cup 20.

A skirt partitioning device is fixedly mounted at a bottom of the cyclone separation unit 10. When the cyclone separation unit 10 is removed from the dust cup 20, the dust scraping device is used to scrape off debris on a first surface of a skirt main body 2 on the skirt partitioning device on the bottom of the cyclone separation unit 10 into the dust cup 20.

It should be noted that the space between the dust cup 20 and the cyclone separation unit 10 is used as a separation chamber. The left side of the separation chamber is referred to as a dirt collection section, and the right side of the separation chamber is referred to as a cyclone separation section. When a dust collector is used to clean a lower to-be-cleaned surface such as the ground, a sofa and a bed, the dirt collection section is located on the lower side of the cyclone separation section along a gravity direction, which is beneficial to the concentration of dust to the dirt collection section under the action of its gravity.

Based on the above embodiment 1 and embodiment 2, the side wall of the dust cup main body has a dust cup air inlet 21 communicating with an air inlet tube. An external dusty air flow sucked by a blower 62 enters from the air inlet tube and enters the separation chamber via the dust cup air inlet 21 so as to be subjected to dust and gas separation. Moreover, when a cleaning apparatus is used, generally, the dirt collection section is located on the lower side of the cyclone separation section in a gravity direction, and therefore, dirt separated by the separation chamber is accumulated on the dirt collection section under the action of gravity. The air inlet tube is disposed on a first transverse connection portion 82 of a main body 80 and communicates with the dust cup air inlet 21, and a structure enabling an intake dusty air flow to spirally advance is arranged in the air inlet tube 10. The linear advance of the dusty air flow is changed into spiral advance, so that the centrifugal force is increased, and the dust collection effect is improved. The left end of the dust cup 20 has a dust pouring opening and a dust cup end cover 22 capable of sealing the dust pouring opening, the dust cup end cover 22 is mounted on the dust cup main body by a hinged piece, and the top end of the dust cup end cover 22 passes through an engagement member so that the dust cup end cover 22 is kept on a closed position. The dust cup end cover 22 is capable of rotating between the closed position and an open position. On the closed position, the dust cup end cover 22 keeps the dirt on the dirt collection section; and on the open position, the dirt may be removed from the dirt collection section.

Further, the dust scraping ring 50 has an L-shaped radial section, the connection portion being a transverse portion of the L-shaped radial section, and the dust scraping portion being a vertical portion of the L-shaped radial section. The L-shaped structure is simple and is more compact than that in the related art, moreover, the spatial proportion is small, so that interference with other components on the dust scraping ring 50 and the cyclone separation unit 10 is minimized. The radial section is not limited to be L-shaped and may also be of a T-shaped structure.

Further, the dust scraping ring 50 includes a mounting ring 51 and an annular dust scraping plate 52. An outer wall of the mounting ring 51 is fixedly coupled to the interior of the dust cup 20. The annular dust scraping plate 52 is an L-shaped vertical dust scraping portion and is integrally formed on the side, located on the open portion of the dust cup 20, of the mounting ring 51 and radially extends inwards to abut against the filter screen 11. When the cyclone separation unit 10 is removed from the dust cup 20, the filter screen 11 slides past the annular dust scraping plate 52 and the debris is scraped off.

Further, an initial position of the annular dust scraping plate 52 is a position where an inner ring of the annular dust scraping plate 52 abuts against a seat 111 of the filter screen 11, so that the annular dust scraping plate 52 scrapes off dust from the filter screen 11 on the seat 111 of the filter screen 11, then, it is ensured that the dust on the overall filter screen 11 may be scraped off by the dust scraping ring 50, and thus, the dust scraping effect of the annular dust scraping plate 52 is improved.

Further, the dust scraping device further includes a connection base 30 coaxial with the dust scraping ring 50 and a dust scraping ring mounting rack 40. The connection base 30 is fixed to the open portion of the dust cup 20, the dust scraping ring mounting rack 40 is arranged in the connection base 30, and the side, away from the open portion, of the dust scraping ring mounting rack 40 is fixedly coupled to the dust scraping ring 50. In some embodiments, the dust scraping ring 50 is detachably coupled to the dust scraping ring mounting rack 40, so that it is convenient to replace the dust scraping ring 50.

In some embodiments, a positioning boss is formed between the connection base 30 and the dust scraping mounting rack 40. The positioning boss is used for limiting the peripheral direction of the dust scraping ring 50 on the dust cup 20 and then fixing the connection base 30 and the dust cup 20 in a glue bonding manner.

Further, based on the above technical solutions, referring to FIG. 2, the dust scraping device in the present embodiment further includes a supporting washer 70 coaxially arranged in the mounting ring 51, the outer peripheral surface of the supporting washer 70 abuts against the inner peripheral surface of the mounting ring 51, the end of the supporting washer 70 abuts against the annular dust scraping plate 52, and the supporting washer 70 is used for supporting the mounting ring 51 and the annular dust scraping plate 52, so that the overall strength of the dust scraping ring 50 and the dust scraping effect are improved. Moreover, the dust cup 20 is coaxially coupled to a main machine 60 by an engagement structure. The dust scraping device is arranged on the open portion, coupled to a main machine housing 61, of the dust cup 20.

Figure 7:
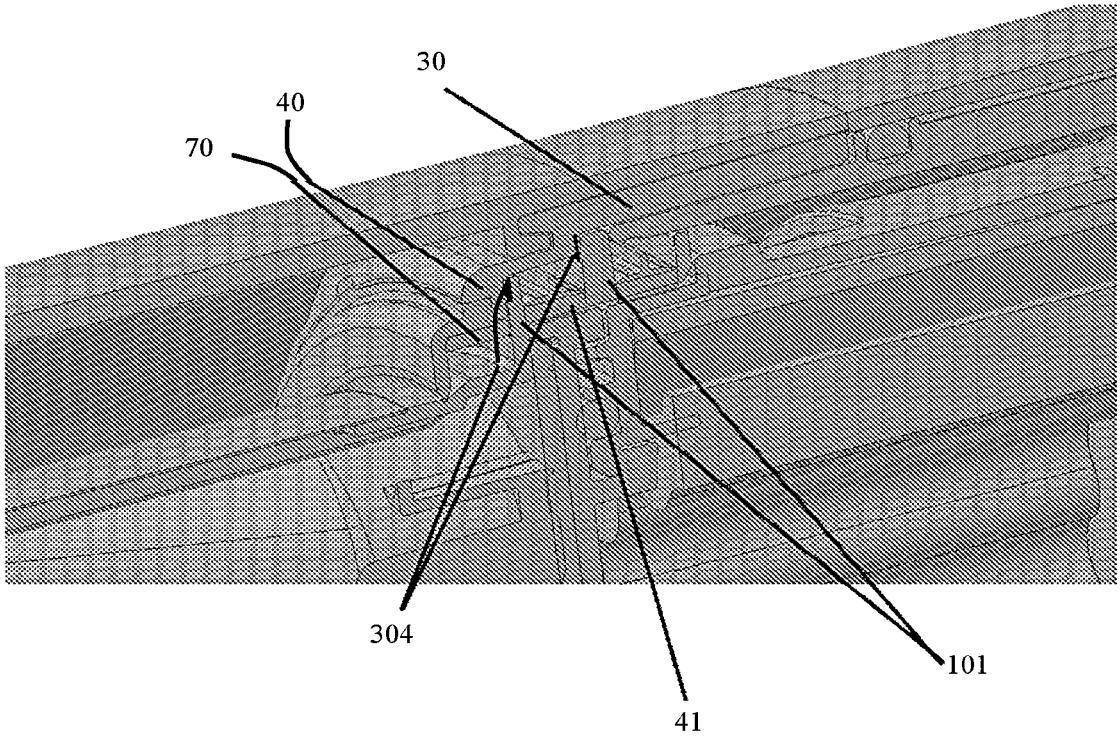
FIG. 7 is a perspective view of part A in FIG. 2.

Further, as shown in FIG. 7, an annular positioning step 304 is formed at a junction between an inner side wall of the connection base 30 and the dust scraping ring mounting rack 40 and is used to position the cyclone separation unit 10; a cooperation step 101 is formed at the cyclone separation unit 10 and cooperates with the annular positioning step 304. The cyclone separation unit 10 is mounted in such a way that the cyclone separation unit is exactly engaged with the positioning step 304, and the seat 111 on the filter screen 11 abuts against the annular dust scraping plate 52, precisely positioning and rapidly mounting the cyclone separation unit 10.

Further, as shown in FIG. 7, a seal ring 41 is arranged between the annular positioning step 304 and the cooperation step 101, so that the sealing property for connection between the cyclone separation unit 10 and the dust cup 20 is improved.

Further, the dust scraping ring 50 is made of a rubber material such as a TPU material, so that the performance of deformability of the dust scraping ring 50 moving relative to the cyclone separation unit 10 is improved, and interference with components such as the skirt partitioning device in the cyclone separation unit 10 is convenient to generate.

Embodiment 3

Figure 4:
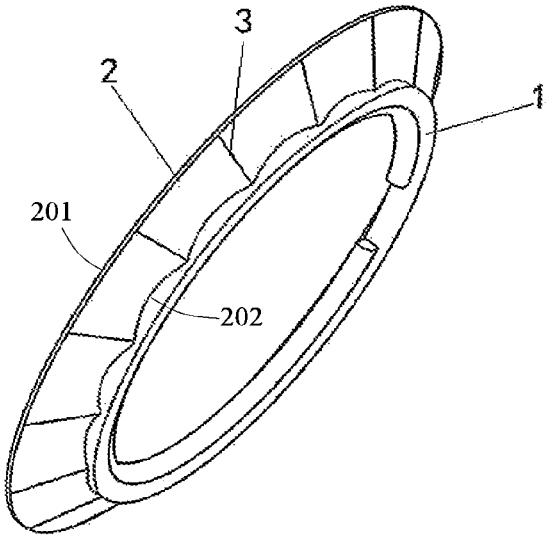
FIG. 4 is a perspective view of a skirt partitioning device according to the present disclosure.
Figure 5:
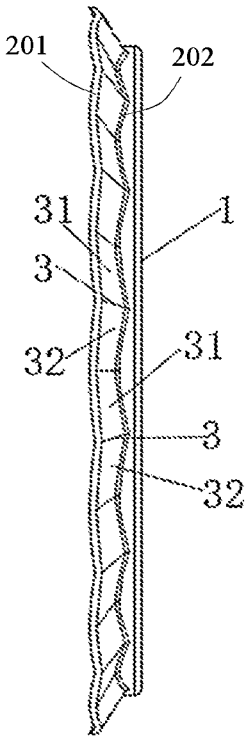
FIG. 5 is a left view of a skirt partitioning device according to the present disclosure, in which a material of an outer ring of a skirt main body is partially removed.
Figure 6:
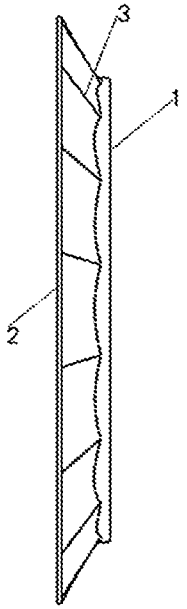
FIG. 6 is a left view of a skirt partitioning device according to the present disclosure, in which no material is removed.

Referring to FIG. 4 to FIG. 6, a skirt partitioning device is mounted on a cyclone separation unit of a cleaning apparatus. The skirt partitioning device is of an annular structure. The skirt partitioning device includes an annular inner ring 1 and an annular skirt main body 2.

The skirt main body 2 has a root 201 coupled to the inner ring 1 and an edge part 202 at an end, away from the inner ring 1, of the skirt main body 2. A diameter of the edge part 202 is greater than a diameter of the root 201. A plurality of collapsing portions 3 are formed on the skirt main body 2 and arranged at intervals in a peripheral direction of the skirt main body 2, and each of the collapsing portions 3 is of a strip-shaped structure extending in a radial direction of the skirt main body 2.

In a thickness direction of the skirt main body 2, the collapsing portions 3 protrude on a first side surface of the skirt main body 2 relative to the skirt main body 2 and are recessed on a second side surface of the skirt main body 2 relative to the skirt main body 2. Moreover, on the first side surface of the skirt main body 2, the size of each of the collapsing portions 3 protruding beyond the skirt main body 2 is gradually reduced from the root 201 to the edge part 202.

The present disclosure provides the skirt partitioning device including the inner ring 1 and the skirt main body 2. The plurality of collapsing portions 3 are formed on the skirt main body 2; and the collapsing portions 3 protrude on the first side surface of the skirt main body 2 relative to the skirt main body 2 and are recessed on the second side surface of the skirt main body 2 relative to the skirt main body 2. Moreover, on the first side surface of the skirt main body 2, the size of each of the collapsing portions 3 protruding beyond the skirt main body 2 is gradually reduced from the root 201 to the edge part 202. Compared with the related art, the skirt partitioning device is simple in structure while playing a separation role; moreover, the collapsing portions 3 reasonable in layout, arc-shaped connection portions formed between the adjacent collapsing portions 3 are easy to deform to facilitate the passing of dirt, so that the overall skirt partitioning device is moderate in structural hardness and is less likely to interfere with components on the dust cup, and meanwhile, the dirt is effectively separated, so that the dirt smoothly enters a dirt collection section.

Further, on the second side surface of the skirt main body 2, the size of each of the collapsing portions 3 recessed in the skirt main body 2 is gradually reduced from the root 201 to the edge part 202; and/or the size of each of the collapsing portions 3 extending in the peripheral direction of the skirt main body 2 is gradually reduced from the root 201 to the edge part 202. It is ensured that the dirt is effectively separated, and meanwhile, it is convenient for the dirt to smoothly enter the dirt collection section.

Further, referring to FIG. 5, a first arc-shaped connection portion 31 is formed on a first side of each of the collapsing portions 3 in the peripheral direction of the skirt main body 2, and a second arc-shaped connection portion 32 is formed on a second side of each of the collapsing portions 3, wherein the second arc-shaped connection portion 32 of one of the collapsing portions 3 is coupled to the first arc-shaped connection portion 31 of the other adjacent collapsing portion 3, and an arc-shaped connection portion is formed between each of the collapsing portions 3 and the first side surface of the skirt main body 2, so that the appearance is beautiful.

It should be noted that the first side surface of the skirt main body 2 is defined as a surface where a junction of the first arc-shaped connection portion 31 and the second arc-shaped connection portion 32 is located.

Further, an arc-shaped connection portion is formed between each of the collapsing portions 3 and the second side surface of the skirt main body 2.

Further, a third arc-shaped connection portion is formed on one side of each of the collapsing portions 3 in the peripheral direction of the skirt main body 2, and a fourth arc-shaped connection portion is formed on the second side of each of the collapsing portions 3, wherein the fourth arc-shaped connection portion of one of the collapsing portions 3 is coupled to the third arc-shaped connection portion of the other adjacent collapsing portion 3.

Further, on the first side surface of the skirt main body 2, the sizes of the collapsing portions 3 protruding beyond the skirt main body 2 are gradually reduced from the root 201 to the edge part 202 until disappear; and on the second side surface of the skirt main body 2, the sizes of the collapsing portions 3 recessed in the skirt main body 2 are gradually reduced from the root 201 to the edge part 202 until disappear, so that the edge part 202 is smooth; and/or the inner ring 1 is an annular structural member, the inner side wall of the inner ring 1 has an engagement portion coupled to a cyclone separation unit 10, and the engagement portion facilitates the mounting and dismounting of the inner ring 1 and the cyclone separation unit 10. The inner ring 1 is integrally formed with the root 201 in a peripheral direction of an outer side wall of the inner ring. The inner ring 1 and the root 201 of the skirt main body 2 form wavy shapes in the peripheral direction of the outer side wall of the inner ring. An annular engagement slot is formed in the left side end of the inner ring 1 and is assembled together with the bottom of the cyclone separation unit 10.

Further, the skirt partitioning device is made of silicon rubber. The silicon rubber material is good in deformation effect and facilitates the smooth passing of the dirt.

The skirt partitioning device forms an angle towards an outer wall of a dust cup 20 and extends away from a central axis; and/or the dust cup 20 includes a cylindrical main body. A dust cup end cover 22 is arranged at a first end of the cylindrical main body in an axis direction of the cylindrical main body, and an open portion is arranged on a second end of the cylindrical main body. The skirt partitioning device is located in the middle of the cylindrical main body, wherein a dirt collection section is formed between the dust cup end cover 22 and the skirt partitioning device, a cyclone separation section is formed between the open portion and the skirt partitioning device, and the skirt main body obliquely extends to the dirt collection section.

Further, the skirt main body 2 is made of an elastically deformable material.

The skirt main body 2 is extruded and deformed toward the central axis and away from the open portion on the dust cup 20, so that the skirt main body 2 is located on a first position; and the skirt main body 2 is extruded and deformed in a direction opposite to the first position, so that the skirt main body 2 is located on a second position. In such a way, the skirt main body 2 deforms between the first position and the second position.

In a process that the cyclone separation unit is removed from the interior of the dust cup 20, when passing through a dust scraping structure, the skirt main body 2 is pressed to shrink and deform in a direction opposite to a removal direction of the cyclone separation unit and generate crumples on the positions of the collapsing portions 3 (which is similar to the state that an umbrella is folded), so that the skirt main body 2 is located on the first position; and after passing through the dust scraping structure, the skirt main body 2 is automatically restored to an unfolded state under the action of an elastic restoring force itself. In a process that the cyclone separation unit is mounted in the dust cup 20, when passing through the dust scraping structure, the skirt main body 2 is pressed to deform in a direction opposite to a mounting direction of the cyclone separation unit, so that the skirt main body 2 is located on the second position; and after passing through the dust scraping structure, the skirt main body 2 is automatically restored to an unfolded state under the action of an elastic restoring force itself.

A specific working manner of the skirt partitioning device is that: in a first case, when large-sized dirt moves from a cyclone separation chamber to a dirt collection chamber, a force generated when the dirt acts on the skirt main body 2 may cause deformation of the arc-shaped connection portion formed between the adjacent collapsing portions of the skirt main body 2. Therefore, a stressed position of the skirt main body 2 may deform to allow the dirt to smoothly pass by.

In a second case, in a process that the cyclone separation unit 10 is dismounted, it is determined whether the skirt main body 2 is required to be folded according to the size of a removal opening of the cyclone separation unit 10.

Interference occurs when a dust scraping device on the dust cup 20 and the skirt main body 2 fixedly arranged on the cyclone separation unit 10 pass, and the arc-shaped connection portions formed between the adjacent collapsing portions deform and are stressed to be folded.

If the cyclone separation unit 10 may be removed and the size of the open portion on the dust cup 20 is large enough, the skirt main body 2 is not folded and is directly removed.

Further, the cleaning apparatus further includes an integrated filter element 90 which is arranged on an outlet end of a cyclone cone and is used for filtering air separated at a second cyclone separation stage again. The integrated filter element 90 is detachably arranged in the cyclone separation unit so as to be conveniently replaced. Meanwhile, air separated from a second separation unit is further filtered by the integrated filter element 90, so that fewer impurities in the air are discharged to the outside, and a dust collection effect is better.

In the description of the present disclosure, it should be understood that terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "an example," "a specific example," or "some examples," means that a particular feature, structure, material, or characteristic described in connection with the embodiment or example is included in at least one embodiment or example of the present disclosure. Thus, these phrases in various places throughout this specification are not necessarily referring to the same embodiment or example of the present disclosure. Furthermore, the particular features, structures, materials, or characteristics may be combined in any suitable manner in one or more embodiments or examples. Moreover, different embodiments or examples as well as features in different embodiments or examples described in the present disclosure may be combined or integrated by those skilled in the art.

Although embodiments of the present disclosure have been shown and described, it would be appreciated by those skilled in the art that the above embodiments are exemplary and cannot be construed to limit the present disclosure, and changes, modifications, alternatives and variations can be made in the embodiments without departing from the scope of the present disclosure.

What is claimed is:

1. A cleaning apparatus, comprising:

a gun-shaped main body;

a main machine mounted on the main body;

a dust cup;

a removable cyclone separation unit arranged in the dust cup; and a dust scraping device, wherein:

the dust cup and the main machine are arranged on the main body, and the dust scraping device is fixedly mounted at the dust cup and is coupled to the main machine by an engagement slot formed in the dust scraping device and an engagement block formed outside a connection end of a main machine housing of the main machine;

the dust scraping device comprises:

a dust scraping member configured as a cylindrical dust scraping ring and having an L-shaped radial section, a transverse portion of the L-shaped radial section extending in a removal direction of the cyclone separation unit, and a vertical portion of the L-shaped radial section extending to an interior of the dust cup in a direction perpendicular to the removal direction and slidably abutting against the cyclone separation unit;

a connection base arranged coaxially with the dust scraping ring and fixed to an open portion of the dust cup; and a dust scraping ring mounting rack arranged coaxially with the dust scraping ring and in the connection base, wherein a side, away from the open portion, of the dust scraping ring mounting rack is fixedly or detachably coupled to the dust scraping ring, wherein the dust scraping device is mounted at the dust cup, and the vertical portion is a dust scraping portion and scrapes off at least part of debris on an outer side of the cyclone separation unit when the cyclone separation unit is removed from the dust cup.

2. The cleaning apparatus according to claim 1, wherein:

the dust cup comprises a cylindrical main body;

a dust cup end cover covering a first end cylindrical main body, and the open portion is arranged on a second end of the cylindrical main body.

3. The cleaning apparatus according to claim 1, further comprising a skirt partitioning device mounted at a bottom of the cyclone separation unit, wherein the skirt partitioning device comprises an annular inner ring and an annular skirt main body.

4. The cleaning apparatus according to claim 3, wherein:

the skirt main body has a root coupled to the inner ring and an edge part at an end, away from the inner ring, of the skirt main body, and the edge part has a diameter greater than the root.

5. The cleaning apparatus according to claim 3, wherein the skirt partitioning device forms an angle towards an outer wall of a dust cup and extends away from a central axis.

6. The cleaning apparatus according to claim 3, wherein the skirt main body is made of an elastically deformable material.

7. The cleaning apparatus according to claim 3, wherein:

a plurality of collapsing portions are formed on the skirt main body and arranged at intervals in a peripheral direction of the skirt main body, and each of the collapsing portions has a strip-shaped structure extending in a radial direction of the skirt main body.

8. The cleaning apparatus according to claim 7, wherein a first arc-shaped connection portion is formed on a first side of each collapsing portion in the peripheral direction of the skirt main body, and a second arc-shaped connection portion is formed on a second side of each collapsing portion.

9. The cleaning apparatus according to claim 3, wherein:

the collapsing portions protrude on a first side surface of the skirt main body relative to the skirt main body and are recessed on a second side surface of the skirt main body relative to the skirt main body, in a thickness direction of the skirt main body.

10. The cleaning apparatus according to claim 9, wherein a size of each collapsing portion protruding beyond the skirt main body on the first side surface of the skirt main body is gradually reduced from the root to the edge part.

11. The cleaning apparatus according to claim 9, wherein a size of each collapsing portion recessed in the skirt main body on the second side surface of the skirt main body is gradually reduced from the root to the edge part.

12. A dust scraping device for a cleaning apparatus, the cleaning apparatus comprising a dust cup and a removable cyclone separation unit arranged in the dust cup, wherein:

the dust scraping device comprises:

a dust scraping member configured as a cylindrical dust scraping ring and having an L-shaped radial section, a transverse portion of the L-shaped radial section extending in a removal direction of the cyclone separation unit, and a vertical portion of the L-shaped radial section extending to an interior of the dust cup in a direction perpendicular to the removal direction and slidably abutting against the cyclone separation unit;

a connection base arranged coaxially with the dust scraping ring and fixed to an open portion of the dust cup; and a dust scraping ring mounting rack arranged coaxially with the dust scraping ring and in the connection base, wherein a side, away from the open portion, of the dust scraping ring mounting rack is fixedly or detachably coupled to the dust scraping ring, wherein the dust scraping device is mounted at the dust cup, and the vertical portion is a dust scraping portion and scrapes off at least part of debris on an outer side of the cyclone separation unit when the cyclone separation unit is removed from the dust cup.

13. The dust scraping device according to claim 12, wherein:

the dust cup has a cylindrical dust cup main body and the open portion arranged at an end of the dust cup main body;

the dust scraping ring is coaxially mounted at the open portion of the dust cup;

the cyclone separation unit is coaxially arranged within the dust cup, and the cyclone separation unit comprises a cylindrical filter screen and a cyclone separation portion located downstream of the filter screen; and the dust scraping ring scrapes off debris on an outer side of the filter screen.

14. The dust scraping device according to claim 13, wherein the dust scraping ring is made of a rubber material.

15. The dust scraping device according to claim 12, wherein:

the dust scraping ring comprises a mounting ring and an annular dust scraping plate;

an outer wall of the mounting ring is fixedly coupled to the interior of the dust cup;

the annular dust scraping plate is integrally formed on a side, away from the open portion, of the mounting ring, radially extends inwards, and abuts against the filter screen; and the filter screen slides past the annular dust scraping plate and debris is scraped off when the cyclone separation unit is removed from the dust cup.

16. The dust scraping device according to claim 15, further comprising:

a supporting washer arranged coaxially in the mounting ring, wherein:

the supporting washer has an outer peripheral surface of the supporting washer abutting against an inner peripheral surface of the mounting ring, the supporting washer has an end abutting against the annular dust scraping plate and supports the mounting ring and the annular dust scraping plate.

17. The dust scraping device according to claim 15, wherein an initial position of the annular dust scraping plate is a position where an inner ring of the annular dust scraping plate abuts against a seat of the filter screen.

18. The dust scraping device according to claim 15, wherein:

an annular positioning step is formed at a junction between an inner side wall of the connection base and the dust scraping ring mounting rack and positions the cyclone separation unit;

a cooperation step is formed at the cyclone separation unit and cooperates with the annular positioning step; and a seal ring is arranged between the annular positioning step and the cooperation step.

* * * * *